United States Patent [19]

Itaya et al.

[11] Patent Number: 4,486,089

[45] Date of Patent: Dec. 4, 1984

[54] MAGNETIC BRUSH DEVELOPING MEANS

[75] Inventors: Masahiko Itaya; Satoshi Haneda; Yukio Okamoto, all of Hachioji, Japan

[73] Assignee: Konishiroku Photo Industry Co., Ltd., Tokyo, Japan

[21] Appl. No.: 401,859

[22] Filed: Jul. 26, 1982

[30] Foreign Application Priority Data

Aug. 10, 1981 [JP] Japan ..... 56-124110

[51] Int. Cl.[3] ..... G03G 15/00

[52] U.S. Cl. ..... 355/3 DD; 355/14 D; 118/653; 118/657; 430/122

[58] Field of Search ..... 355/3 DD, 14 D; 118/653, 657, 658; 430/122

[56] References Cited

U.S. PATENT DOCUMENTS 4,330,193 5/1982 Stange ..... 355/3 DD
4,364,659 12/1982 Noda ..... 355/3 DD X
4,397,539 8/1983 Normand ..... 355/3 DD

*Primary Examiner*—A. C. Prescott
*Attorney, Agent, or Firm*—Jordan B. Bierman

[57] ABSTRACT

A magnetic brush developing apparatus for an electrophotographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the the above, a soft developer body is obtained, and density unevenness or striping of the image is avoided.

4 Claims, 4 Drawing Figures

MAGNETIC BRUSH DEVELOPING MEANS

BACKGROUND OF THE INVENTION

1. Field of the Invention

The present invention relates to a magnetic brush developing means in an electrophotographic copying machine and an electrostatic recording apparatus.

2. Description of the Prior Art

In a magnetic brush developing means, the developer containing magnetic powder is adsorbed on the non-magnetic holder having magnets arranged therein due to the magnetic force of said magnets. The developer carried in the shape of a brush on the non-magnetic holder is then brought into contact with the electrostatic latent image formed on a charge receptor at the developing position, thus said electrostatic latent image is developed.

There are two types of developer, one is a two-component developer consisting essentially of a non-magnetic toner and a magnetic carrier and the other is a one-component developer consisting essentially of a magnetic toner. One-component developer is further classified into a conductive magnetic toner and a dielectric magnetic toner. The development is made in a way that toner charged in the polarity opposite to the electrostatic latent image is electrostatically adsorbed to the electrostatic latent image. In a two-component developer, a toner is charged by the friction with a carrier and the toner with a smaller grain diameter adheres to a carrier with a larger grain diameter, thus a magnetic brush is formed. In a single-component developer, a conductive magnetic toner is charged by the injection of an electric charge or by an electrostatic induction and a dielectric magnetic toner is frictionally charged by the member that makes contact with the toner in a developing container or in the middle of the transportation.

As a non-magnetic holder to adsorb developer and to form a magnetic brush, there exist various types in a sleeve shape, a cylinder shape and an endless belt shape. Inside the holder, typically a plurality of magnet pieces are provided radially, or magnetic poles are arranged on the peripheral surface of a bar magnet. As a latent image holder, on the other hand, there exist a photosensitive receptor that is used for an electrophotographic copying machine and a dielectric to be used for an electrostatic recording apparatus and their shape spans over a drum shape, an endless belt shape, a plate shape and a sheet shape.

FIG. 1 shows a conventional magnetic brush developing means. Inside a cylindrical sleeve 1 that is a non-magnetic holder, there are aranged a plurality of magnet pieces 2 in a way that their polarity oppose each other and a magnetic field strength distribution shown in FIG. 2 is given on the sleeve 1, which causes earing of the developer 3, and either one or both of the sleeve 1 and magnet pieces 2 are rotated solidly in a direction of the arrow as shown. The toner 3 that ears moves on the sleeve 1 and further moves to the position of a charge receptor 5, namely, to the developing position after being made to a uniform height by the developer layer regulating plate 4. It is contacted to the surface of the charge receptor 5, which that moves at a constant speed, and develops electrostatic latent images continuously.

In this developing means, the ear of aforesaid developer 3 is soft and consequently the cohesion of aforesaid developer does not easily take place when contacting the charge receptor 5 or the developer layer regulating plate 4. Further, the electric chargeability of said developer is excellent because stirring of said developer takes place on the sleeve 1. However, due to the magnetic field generated on the sleeve 1, there has been a tendency that the transporting force to transport the developer 3 is weak and thereby the cohesion of said developer takes place on the sleeve 1 and further the transportability remarkably lowers when a toner filming takes place. Further, uneven density in the form of lateral stripes synchronized with the moving speed of the developer layer sometimes occurs on the recorded image because developer located by a width of W eared with the magnetic field of a magnetic pole has affected the development at the developing position.

SUMMARY OF THE INVENTION

The object of the present invention is to offer a magnetic brush developing means comprising a non-magnetic sleeve having a magnet therein for absorbing and carrying a developer comprising a magnetic material on the surface of said sleeve. The developer develops an electrostatic latent image formed on a charge receptor. The developing means is characterized in that said non-magnetic sleeve moves in the direction of the movement of said developer to the developing position, and said magnet is a magnetic roll wherein a plurality of magnet pieces having a magnetic field strength distribution with a plurality of peaks are arranged so that their polarity oppose each other thereby solving the aforesaid problems.

DETAILED DESCRIPTION OF THE PREFERRED EMBODIMENTS

Figure 1:
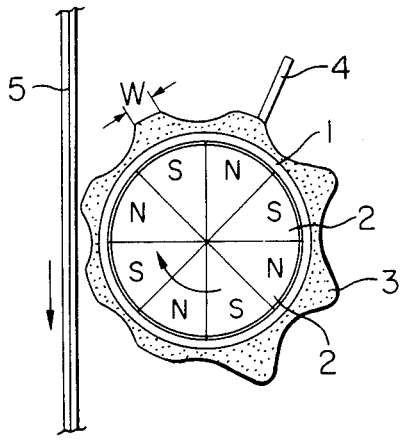
FIG. 1 PRIOR ART
FIG. 1 shows a schemetic diagram for the main parts of a conventional magnetic brush developing apparatus.
Figure 2:
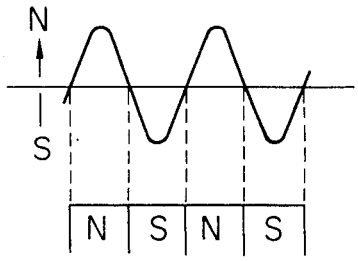
FIG. 2 is a diagram showing the magnetic field strength distribution of the apparatus of FIG. 1.
Figure 3:
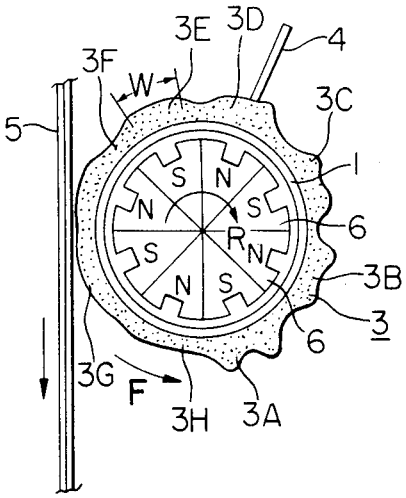
FIG. 3 shows a schematic diagram for the main parts of an example of the present invention.

FIG. 3 illustrates an example of the present invention. The difference between FIG. 3 and FIG. 1 is that magnet pieces 6 are of the concaved shape structure whose both sides are protrudent and the center portion is flat and concave and the magnet roll wherein these magnet pieces 6 are arranged in a reciprocal opposite polarity rotates in the direction of R which is opposite to the rotating direction F of a cylindrical sleeve 1, namely, the direction of movement of a developer 3 toward the developing position. In the magnet roll, therefore, plural magnetic pole sections are composed by magnet pieces 6 each of which is substantially one body that generates the magnetic field strength distribution having two peaks, as shown by the solid line in FIG. 4, and according to the magnetic field strength distribution, the earing of the developer 3 is in a state of two peaks per single piece of magnetic pole. Incidentally, it is possible to cause each magnet piece to have the magnetic field strength distribution having two sufficient peaks even with a shallow dent because each magnet piece 6 has a magnetic pole that is opposite in polarity to that of the next one.

Figure 4:
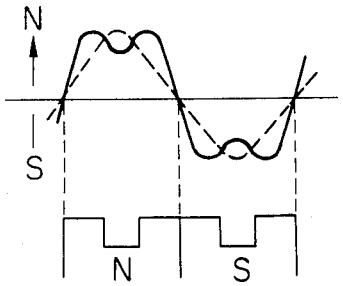
FIG. 4 shows a diagram of the magnetic field strength distribution of the apparatus in FIG. 3.

The magnet roll shown in the present example has a magnetic field strength distribution having two peaks as shown by the solid line in FIG. 4 and when it is compared with the characteristic of the conventional magnet roll shown by the dotted line in the same Figure, the developer cohesion force at the junction section of each magnet piece is strong, namely the cohesion force distribution over the peripheral surface of the sleeve 1 is averaged, transportability of the developer is improved and the width of developer layer W that contributes to the development is increased and therefore the density unevenness in the development does not easily take place. Further, the magnetic field strength on the surface of the sleeve 1 corresponding to the dent of the magnet piece 6 is smaller than that of conventional magnet roll and therefore the developer in that area is free from the strong restriction of the magnetic field and shows a behavior close to a powder cloud, which has an effect to further level the earing distribution of the developer.

Further, the magnet roll shown in the present example moves in the direction opposite to that of the movement of the developer layer caused by the sleeve 1 and therefore, the relative speed between them is great. The developer moves to the developing position being stirred on the surface of the sleeve 1, and triboelectrification is fully made between the sleeve and the developer. The developer is constantly stirred and thus the height of ears of the developer is further leverled. The developer is stirred even at the developing position, and thus disturbance in the development caused by the space potential does not easily take place. In FIG. 3, the earing state of the developer is skeletonized. There is a difference in the height of the ear at 3A section in the same Figure where the developer is supplied, but as the developer advances to 3B and further to 3C position, it receives churning and triboelectrification and the height of the ear thereof is averaged. When it advances to 3D-3E-3F (developing position) after passing through the developer layer thickness regulating plate 4, the height of the ear is further averaged.

As an experiment based on the present invention, the arrangement was made so that the radius of the magnet roll having 8 magnet pieces was 15 mm, the depth of the dent of each magnet piece was 3 mm, the width of the dent was 5 mm, the magnetic field strength peak in the vertical direction on the sleeve 1 was 600 gauss, its rate of rotation was 1200 r.p.m., the rate of rotation of the sleeve 1 was 50 r.p.m., the feeding speed of the image receptor 5 was 180 mm/sec and the clearance between the said receptor 5 and the sleeve 1 was 0.3 mm. A developer was prepared in the process wherein 60 parts by weight of a styrene-acrylate resins (SBM 73), 37 parts by weight of a magnetite (EPT-1000), 1 part by weight of a charge control agent (Vali-fast Black 3804) and 2 parts by weight of a carbonblack (MA-8) were dissolved and kneaded at the same time and then were pulverized and classified and the developer grain powder with an average diameter of 15$\mu$ thus obtained was mixed with a small amount of silica fine powder. The height of the ear at this time was 0.4 mm for the peak and 0.15 mm for the trough. No cohesion of the developer at the developer layer thickness regulating plate and developing position was seen, and a satisfactory developer transportability was obtained. Further, the obtained toner did not produce image fog, and had excellent contrast and resolution.

Incidentally, the present example shows a case wherein the magnet piece has one dent but two or more dents on a magnet piece naturally give more effect for the uniformalization of earing and it is possible to obtain the equal function and effect by modifying the shape of the dent to such as a semicircle.

As explained above, with a magnetic brush developing apparatus of the present invention, an excellent development, wherein the transporting force for developer is not weakened and developer cohesion and density unevenness of the image to be developed do not take place, is possible owing to the constitution wherein a magnet roll in which a plurality of magnet pieces with a magnetic field strength distribution having plural peaks are arranged so that their polarity oppose each other, is arranged inside the sleeve and directions of rotation of the sleeve and the magnet roll are opposite each other.

What is claimed is:

1. In a magnetic brush developing means comprising a non-magnetic sleeve having a magnet therein for absorbing and carrying a developer comprising a magnetic material on the surface of said sleeve, and said developer developing an electrostatic latent image formed on a charge receptor, the improvement wherein said non-magnetic sleeve moves in the direction of the movement of said developer, and said magnet comprises a plurality of magnet pieces arranged circumferentially within said sleeve with alternating polarity, each magnet piece having a structure which provides a magnetic field strength distribution with a plurality of circumferentially spaced peaks.

2. A magnetic brush developing means according to claim 1 wherein said magnetic pieces are of a concaved structure.

3. A magnetic brush developing means according to claim 2, wherein each of said magnetic pieces has opposed protrudent sides connected by a center portion which is flat and concave.

4. A magnetic brush developing means according to claim 1, wherein said magnet rotates in a direction opposite to the direction of rotation of said sleeve.

* * * * *